United States Patent [19]

Place et al.

[11] Patent Number: 4,843,364

[45] Date of Patent: Jun. 27, 1989

[54] THERMOSTATIC ELECTRIC SWITCH

[75] Inventors: Donald E. Place; Ronald L. Holden, both of Mansfield, Ohio

[73] Assignee: Therm-O-Disc, Incorporated, Mansfield, Ohio

[21] Appl. No.: 93,294

[22] Filed: Sep. 4, 1987

[51] Int. Cl.[4] ..... H01H 37/52; H01H 1/00

[52] U.S. Cl. ..... 337/333; 200/284; 200/81.4; 337/373; 337/380; 337/354

[58] Field of Search ..... 200/81.4, 835, 83 P, 200/283, 284; 337/334–340, 354, 379–381, 254, 333, 373–375

[56] References Cited

U.S. PATENT DOCUMENTS

| | | | |
|---|---|---|---|
| 1,458,153 | 6/1923 | Shaw | 439/692 |
| 2,527,108 | 10/1950 | Szabó | 337/35 |
| 2,796,499 | 6/1957 | Barden et al. | 200/284 |
| 2,796,500 | 6/1957 | Barden et al. | 200/284 |
| 2,814,694 | 11/1957 | Moodie, Sr. | 337/399 |
| 2,856,508 | 10/1958 | Kueser | 219/442 |
| 2,904,773 | 9/1959 | Barnett | 439/572 |
| 2,979,585 | 4/1961 | Werr | 337/372 |
| 3,246,107 | 4/1966 | Ebensteiner | 337/364 |
| 3,258,565 | 6/1966 | Them | 337/42 |
| 3,509,417 | 4/1970 | Schmitt | 315/82 |
| 3,870,985 | 3/1975 | Hire | 337/381 |
| 3,893,057 | 7/1975 | Beunk et al. | 337/380 |
| 4,035,756 | 7/1977 | Schmitt | 337/370 |
| 4,103,271 | 7/1978 | Taylor et al. | 337/372 |
| 4,250,361 | 2/1981 | Dvorachek | 200/81.4 X |
| 4,256,973 | 3/1981 | Kochanski et al. | 200/81.4 X |
| 4,464,551 | 8/1984 | Johnson | 200/81.4 X |
| 4,532,389 | 7/1985 | Woods | 200/81.4 X |
| 4,591,677 | 5/1986 | Hirota et al. | 200/81.4 X |

FOREIGN PATENT DOCUMENTS

| | | |
|---|---|---|
| 628936 | 9/1949 | United Kingdom . |
| 636039 | 4/1950 | United Kingdom . |
| 1088404 | 10/1967 | United Kingdom . |
| 1435252 | 5/1976 | United Kingdom . |
| 2178911A | 2/1987 | United Kingdom . |

*Primary Examiner*—J. R. Scott

*Attorney, Agent, or Firm*—Jones, Day, Reavis & Pogue

[57] ABSTRACT

An electric switch, particularly a thermostatic switch, includes contacts connected to at least three terminal members having connector terminals aligned along a common axis.

18 Claims, 9 Drawing Sheets

THERMOSTATIC ELECTRIC SWITCH

BACKGROUND OF THE INVENTION

This application relates to the art of switches and, more particularly, to switches of the type having connector terminals projecting externally of a switch housing. The invention is particularly applicable to thermostatic switches, and will be described with particular reference thereto. However, it will be appreciated that the invention has broader aspects, and can be used for purposes other than thermostatic switches.

A thermostat for two temperature control includes a pair of switches, each having a pair of contacts. Arranging the connector terminals of such a device in line for use with a multifit connector is difficult to accomplish without exceeding the desired envelope in which all of the components are mounted.

It would be desirable to have a thermostat of the type described wherein the terminal members are fitted within a very confined space.

SUMMARY OF THE INVENTION

A thermostat of the type described has a pair of switches having movable arms axially spaced from one another in aligned relationship. Terminal members connected with the switch contacts have connector terminals aligned along a common axis externally of the thermostat housing. The movable arms of the switches have longitudinal axes lying in a plane extending substantially perpendicular to the common axis of the connector terminals.

In a preferred arrangement, the terminal members are mounted in the thermostat housing at locations which are spaced both circumferentially and axially from one another. In such an arrangement, the housing includes a plurality of steps on which the terminal members are secured.

Two of the terminal members have fixed switch contacts mounted thereon, and the other two terminal members are connected with movable switch arms having movable contacts thereon.

Each terminal member has a substantially flat base and a connector terminal extending substantially perpendicular therefrom. Each connector terminal has a different length from its base to its free end.

It is a principal object of the present invention to provide an improved thermostat having in-line connector terminals.

It is also an object of the invention to provide the contacts of a pair of switches with special terminal members such that connector terminals on the terminal members are aligned along a common axis externally of a housing.

It is a further object of the invention to provide an improved thermostat wherein terminal members are mounted in a very confined space, and are so shaped that connector terminals thereon are aligned along a common axis.

DESCRIPTION OF PREFERRED EMBODIMENTS

Figure 1:
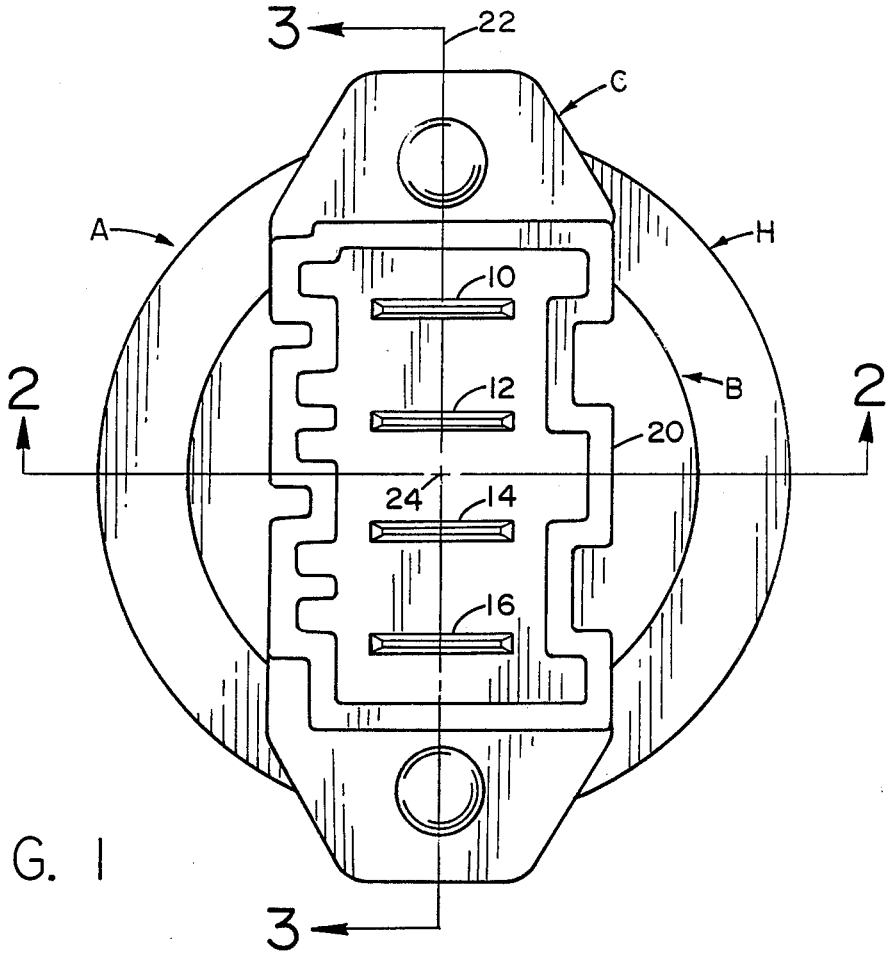
FIG. 1 is an elevational view of the connector terminal end of a thermostat constructed in accordance with the present application.

Referring ow to the drawing, wherein the showings are for purposes of illustrating preferred embodiments of the invention only and not for purposes of limiting same, FIG. 1 shows a thermostat A having a hollow generally cylindrical housing B.

A cover member C attached to housing B has slots therein through which connector terminals 10, 12, 14 and 16 project. Cover member C has an upstanding peripheral wall 20 surrounding connector terminals 10–16 in outwardly-spaced protective relationship thereto.

Connector terminals 10–16 are aligned along a common axis 22 extending perpendicular to and intersecting housing longitudinal axis 24. Connector terminals 10–16 are in the form of flat spade-like members extending parallel to one another, and common axis 22 extends substantially perpendicular to the opposite flat faces of the connector terminals.

Figure 2:
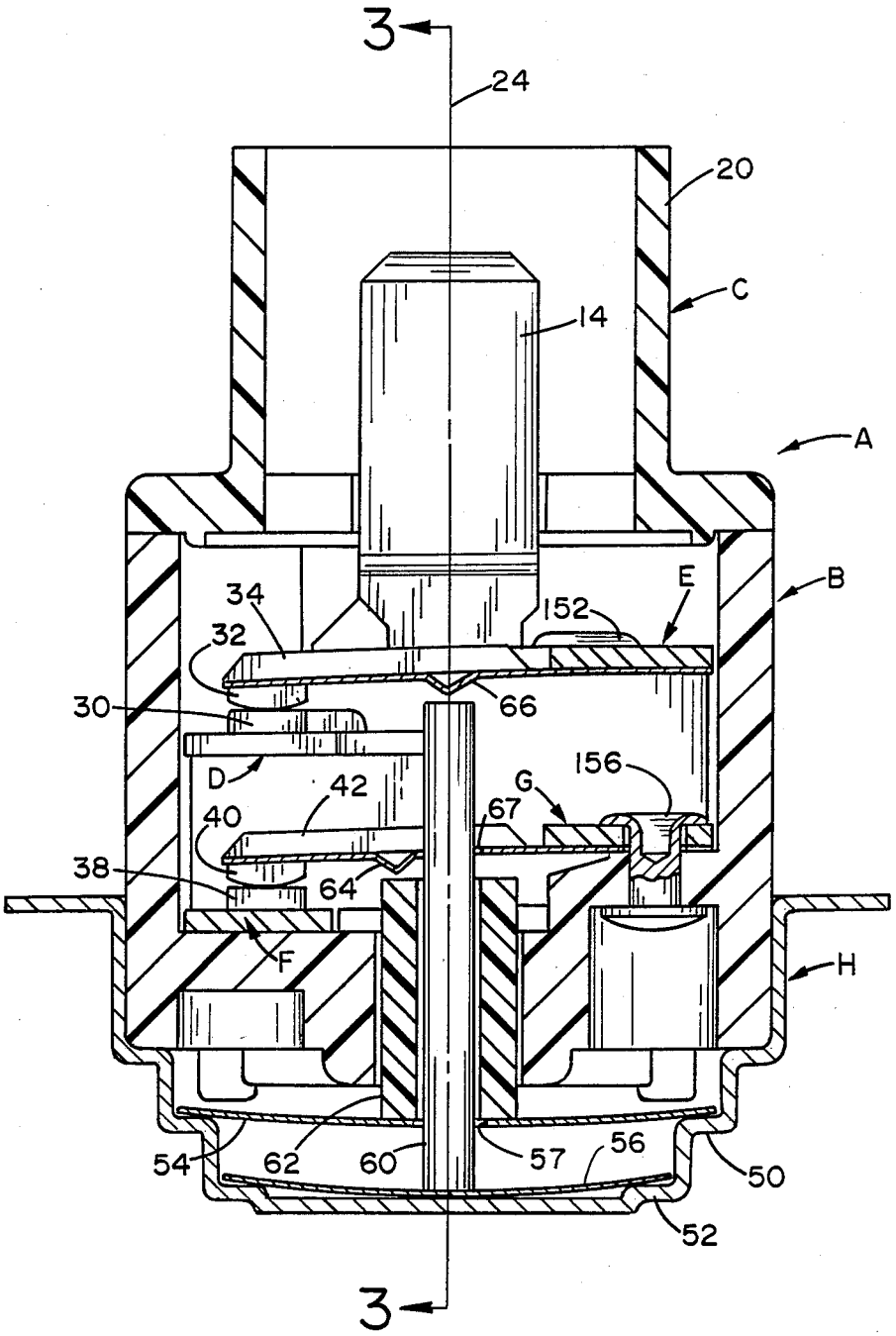
FIG. 2 is a cross-sectional elevational view taken generally on line 2—2 of FIG. 1.

FIG. 2 shows a pair of switches mounted within housing B. One switch has a fixed contact 30 mounted on a terminal member D, and a movable contact 32 mounted on a movable arm 34 connected with a terminal member E. The other switch has a fixed contact 38 mounted on a terminal member F, and a movable contact 40 mounted on a movable arm 42 which is connected with a terminal member G.

A cup member H receives one end of housing B, and has circumferential shoulders 50, 52 on which peripheral portions of bimetal snap discs 54, 56 are supported. The bimetal discs are adapted to operate the two switches at two different temperatures. Bimetal snap disc 54 has a central hole 57 therethrough for freely receiving a ceramic rod 60 which extends freely through a ceramic sleeve 62. Sleeve 62 extends freely through a suitable central hole in the bottom of housing B. Sleeve 62 cooperatively engages a dimple 64 on switch arm 42, and rod 60 engages a dimple 66 on switch arm 34. Rod 60 extends freely through a suitable hole 67 in switch arm 42.

When the design temperature of bimetal snap disc 54 is reached, the disc will snap upwardly from the position shown in FIG. 2 for moving sleeve 62 upwardly along with switch arm 42 for separating contacts 38, 40. When the design temperature of bimetal snap disc 56 is reached, the disc will snap upwardly from the position shown for moving rod 60 upwardly along with switch arm 34 to separate contacts 30, 32.

Figure 3:
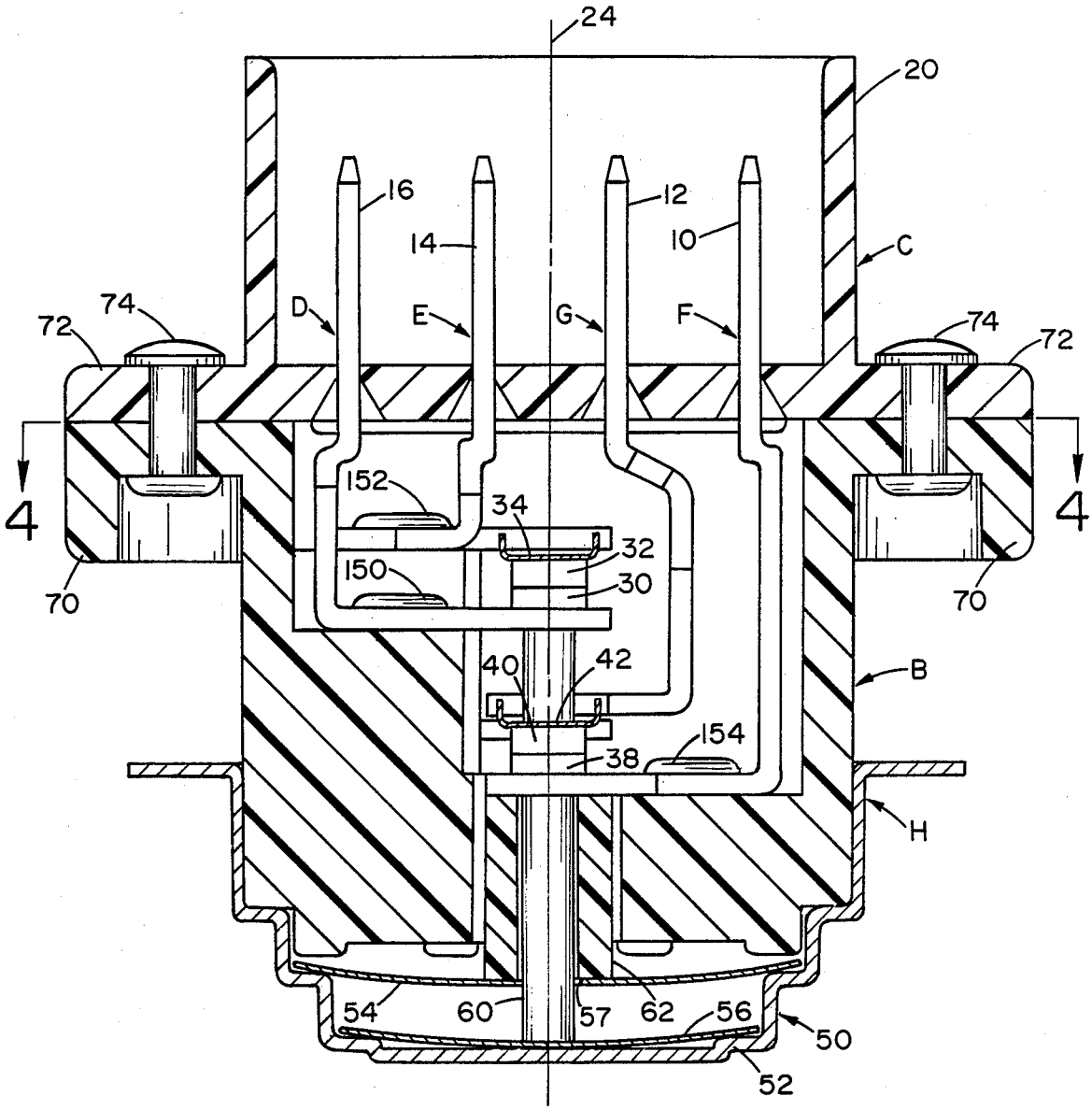
FIG. 3 is a cross-sectional elevational view taken generally on line 3—3 of FIGS. 1 and 2.

As shown in FIG. 3, housing B and cover C have outwardly extending ears 70, 72 with suitable aligned holes therethrough for receiving rivets 74 to secure the cover to the housing. Terminal members D, E, F and G are specially shaped and mounted for enabling alignment of connector terminals 10, 12, 14 16 along a common axis as will become apparent as the description proceeds.

Figure 5:
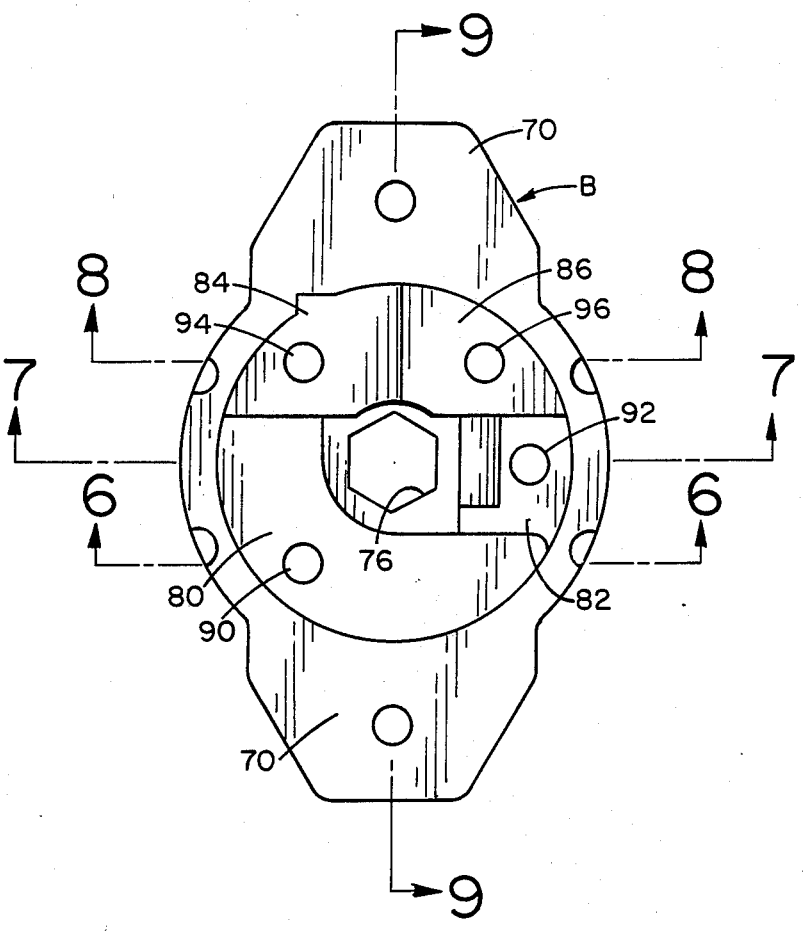
FIG. 5 is a plan view looking into the hollow interior of a housing.
Figure 6:
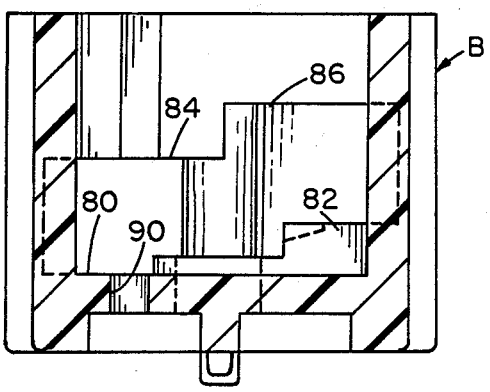
FIG. 6 is a cross-sectional elevational view taken generally on line 6—6 of FIG. 5.
Figure 7:
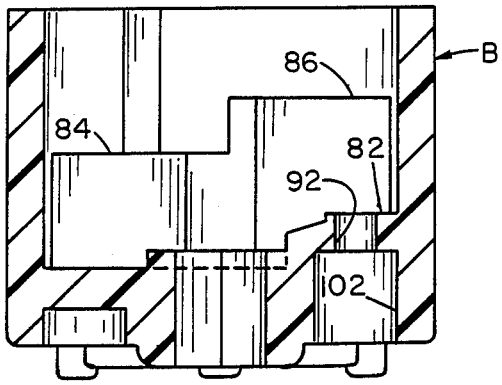
FIG. 7 is a cross-sectional elevational view taken generally on line 7—7 of FIG. 5.
Figure 8:
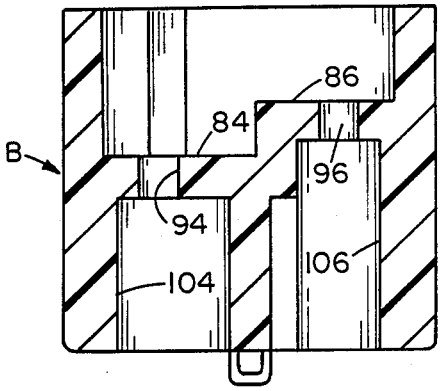
FIG. 8 is a cross-sectional elevational view taken generally on line 8—8 of FIG. 5.
Figure 9:
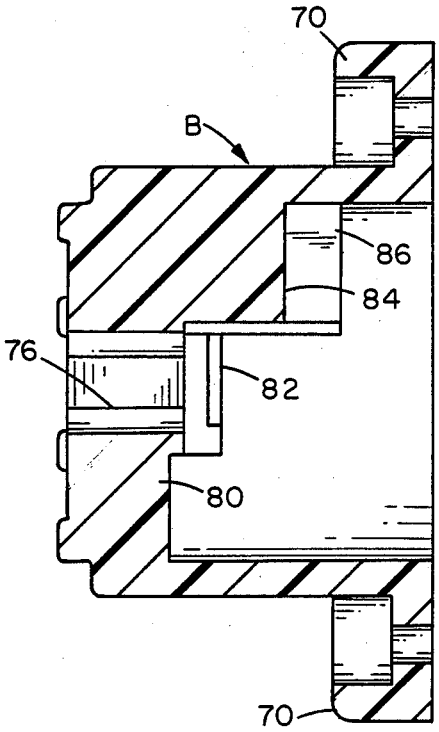
FIG. 9 is a cross-sectional elevational view taken generally on line 9—9 of FIG. 5.

FIG. 5 shows housing B as having a generally cylindrical cavity with central hexagonal hole 76 extending through the bottom thereof for receiving the ceramic sleeve 62 of FIGS. 2 and 3. The interior of the cavity is provided with a plurality of circumferentially and axially-spaced different levels or steps 80, 82, 84 and 86. Each level has a suitable rivet receiving hole therethrough as at 90, 92, 94 and 96. As shown in FIGS. 7 and 8, bores 102, 104 and 106 extend inwardly from the bottom of housing B in alignment with rivet receiving holes 92, 94 and 96 for reducing the thickness of the material at the terminal mounting steps to reduce the rivet length required.

Figure 10:
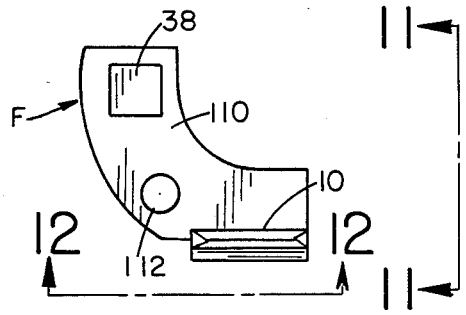
FIG. 10 is a plan view of a bottom fixed contact terminal member.
Figure 11:
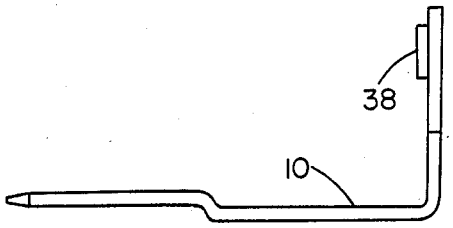
FIG. 11 is an elevational view taken generally on line 11—11 of FIG. 10.
Figure 12:
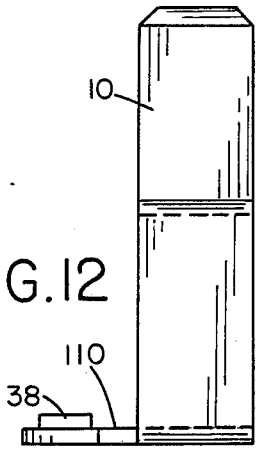
FIG. 12 is an elevational view taken generally on line 12—12 of FIG. 10.

FIGS. 10–12 show terminal member F having a substantially flat arcuate base portion 110 with integral connector terminal 10 extending upwardly substantially perpendicular thereto. Connector terminal 10 and fixed contact 38 are located at opposite end portions of base 110, and a rivet receiving hole 112 is located intermediate connector terminal 10 and fixed contact 38.

Figure 13:
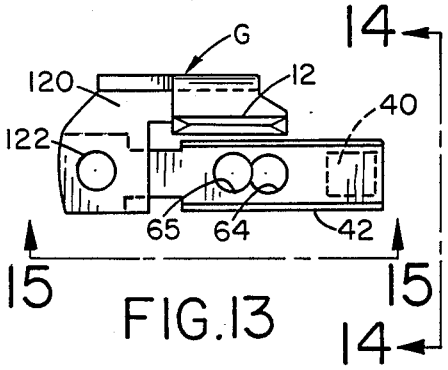
FIG. 13 is a plan view of a bottom movable switch arm terminal member.
Figure 14:
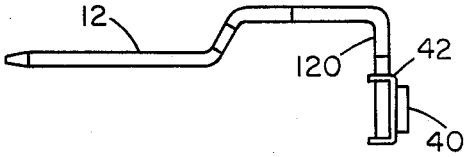
FIG. 14 is an elevational view taken generally on line 14—14 of FIG. 13.
Figure 15:
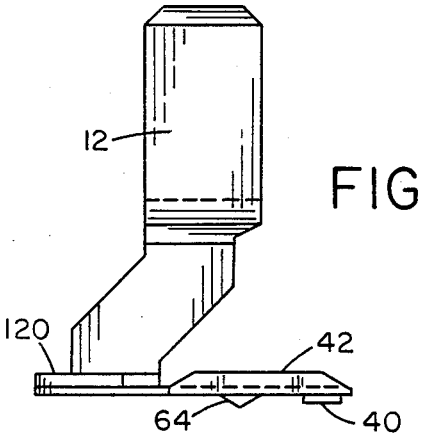
FIG. 15 is an elevational view taken generally on line 15—15 of FIG. 13.

FIGS. 13–15 show terminal member G having integral connector terminal 12 extending upwardly therefrom substantially perpendicular thereto. Base 120 has one end portion of movable arm 42 staked thereto and extending therefrom past connector terminal 12. Aligned rivet receiving holes 122 are provided in base 120 and the end portion of switch arm 42 secured thereto. The hole in switch arm 42 through which rod 60 of FIG. 2 freely extends is shown at 65 in FIG. 13.

Figure 16:
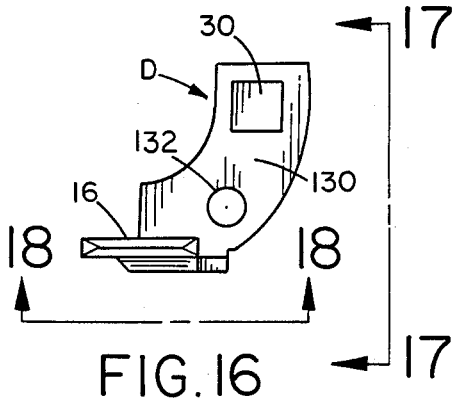
FIG. 16 is a plan view of a top fixed contact terminal member.
Figure 17:
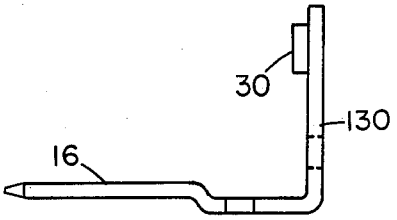
FIG. 17 is an elevational view taken generally on line 17—17 of FIG. 16.
Figure 18:
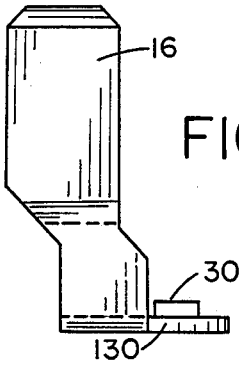
FIG. 18 is an elevational view taken generally on line 18—18 of FIG. 16.

FIGS. 16–18 show terminal member D having substantially flat arcuate base portion 130 with connector terminal 16 extending upwardly therefrom substantially perpendicular thereto. A suitable rivet receiving hole 132 in base 130 is located intermediate connector terminal 16 and fixed contact 30 at opposite end portions of base 130.

Figure 19:
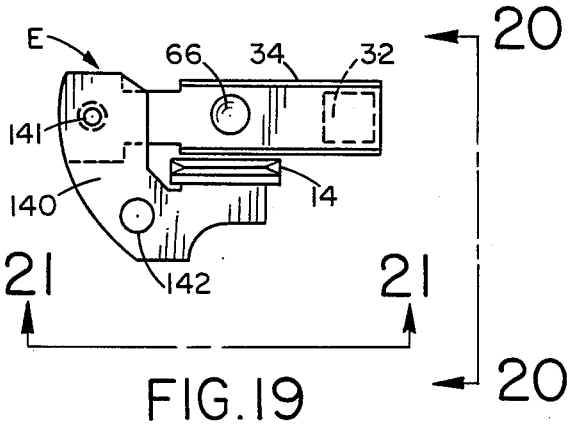
FIG. 19 is a plan view of a top movable switch arm terminal member.
Figure 20:
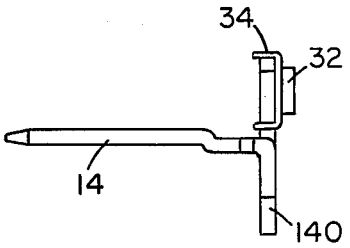
FIG. 20 is an elevational view taken generally on line 20—20 of FIG. 19.
Figure 21:
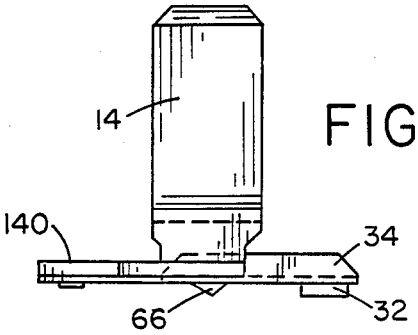
FIG. 21 is an elevational view taken generally on line 21—21 of FIG. 19.

FIGS. 19–21 show terminal member E having a substantially flat arcuate base portion 140 with integral connector terminal 14 extending upwardly therefrom substantially perpendicular thereto. One end portion of movable switch arm 34 is staked to base 140 as generally indicated at 141. Movable switch arm 34 extends outwardly from base 140 past connector terminal 14. A rivet receiving hole 142 is provided in base 140.

All of the terminal members shown in FIGS. 10–21 are of different shapes, and their respective connector terminals have different lengths from their respective flat bases to the free ends thereof. The connector terminals are also bent sideways perpendicular to their flat dimension and/or deformed parallel to their flat dimension in order that all of the connector terminals will be equidistantly spaced from one another and aligned along a common axis.

Figure 4:
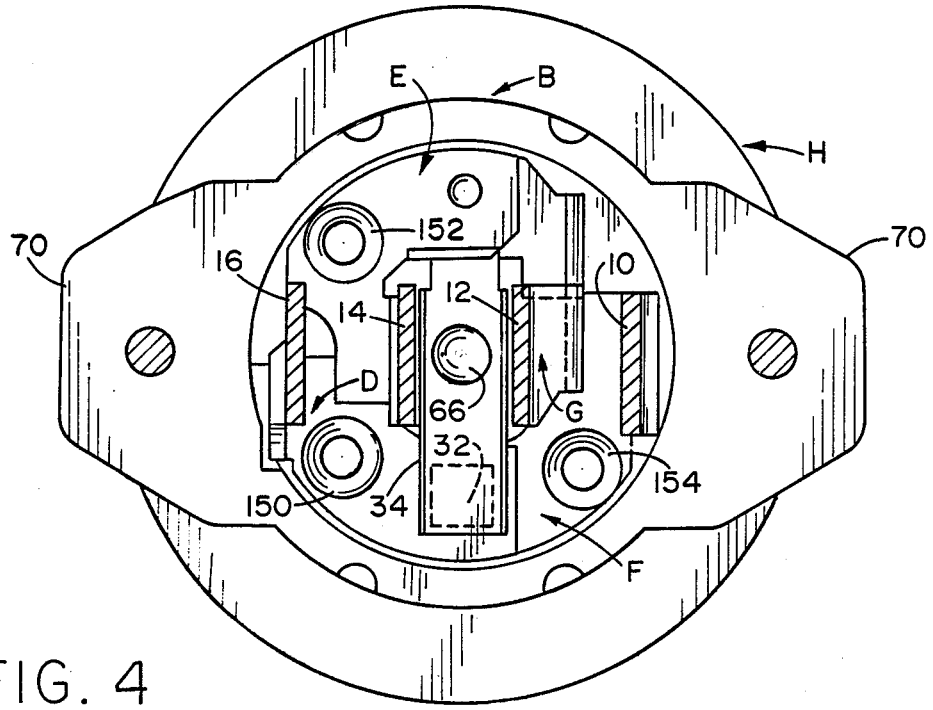
FIG. 4 is a plan view taken generally on line 4—4 of FIG. 3.

FIG. 4 shows hollow rivets 150, 152 and 154, respectively, securing terminal members D, E and F in position within housing B. FIG. 2 shows hollow rivet 156 securing terminal member G within housing B.

Figure 22:
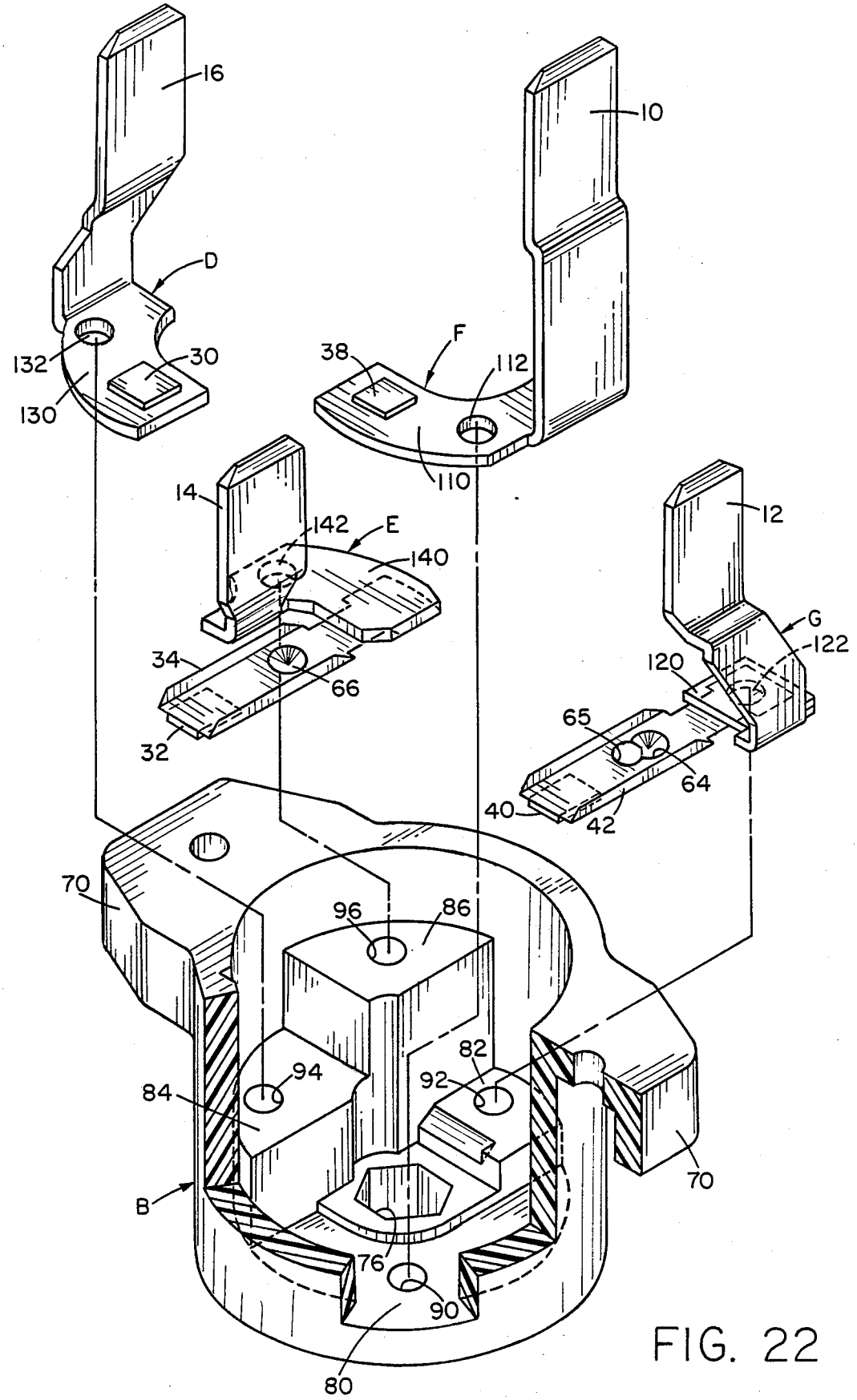
FIG. 22 is a partial perspective illustration showing how the terminal members are mounted within a housing.

FIG. 22 is a diagrammatic exploded perspective showing the general interior shape of housing B with the various steps therein at different levels. FIG. 22 also shows how the various terminal members are positioned and secured within the housing.

In the arrangement shown and described, the pair of switches are located one above the other, with the longitudinal axes of switch arms 34, 42 lying in a common plane which bisects housing B and extends perpendicular to the common axis along which the connector terminals 10–16 lie. The longitudinal axes of switch arms 34, 42 also extend perpendicular to the common axis along which connector terminals 10–16 lie.

As shown in FIG. 2, all of fixed and movable contacts 30, 32, 38 and 40 of the pair of switches are aligned along a common axis extending substantially parallel to thermostat longitudinal axis 24. The opposite outside connector terminals 10, 16 of FIG. 3 are associated with the fixed switch contacts, while the inside connector terminals 12, 14 are associated with the movable switch contacts.

Figure 23:
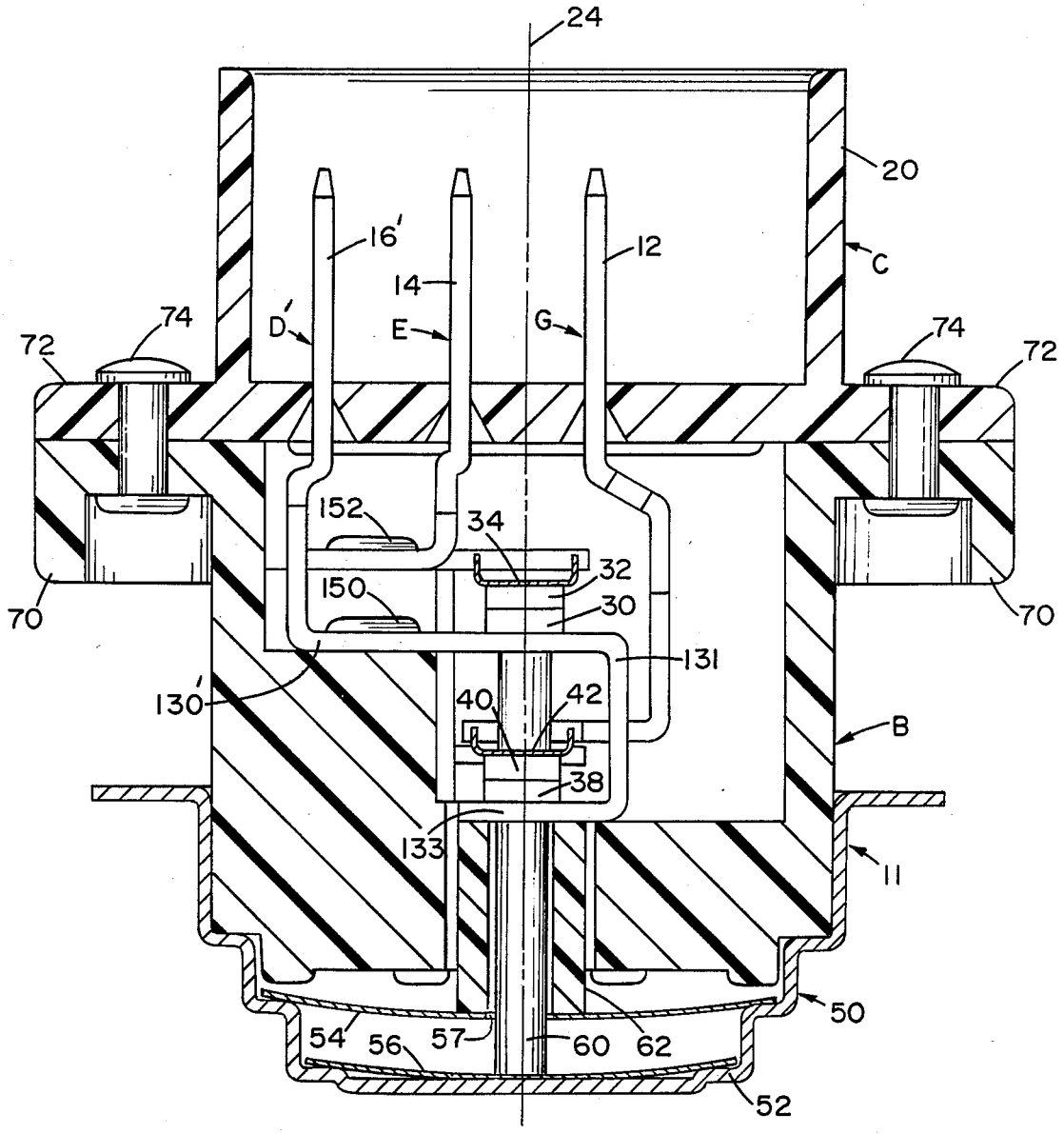
FIG. 23 is a cross-sectional elevational view similar to FIG. 3, and showing another embodiment having three terminal members.

FIG. 23 shows an alternative embodiment having only three connector terminals, and with parts common to the embodiment of FIGS. 1–22 being identified by common reference numbers and letters.

Base 130' of terminal member D' has an integral vertical depending leg portion 131 terminating in a reversely extending subbase 133. Base 130' and subbase 133 are vertically spaced from one another in parallel relationship.

Switch contacts 30 and 38 are both attached to terminal member D'. Contact 30 of one switch is welded to base 130', while contact 38 of the other switch is welded to subbase 133. This arrangement provides aligned connector terminals 12, 14 and 16', with one contact of each switch being attached to connector terminal 16'.

In the arrangement of the present application, all of the terminal members are substantially directly connected with their respective contacts instead of being connected thereto through another adaptor member or the like. The improved arrangements of the present application make it possible to mount four terminal members in a very confined space while enabling alignment of four external connector terminals.

Although the invention has been shown and described with respect to a preferred embodiment, it is obvious that equivalent alterations and modifications will occur to others skilled in the art upon the reading and understanding of this specification. The present invention includes all such equivalent alterations and modifications, and is limited only by the scope of the claims.

We claim:

1. An electrical device including a housing having a longitudinal axis, at least three different terminal members, means for mounting said terminal members in said housing at different mounting locations all of which are spaced both axially and circumferentially from one another, and said terminal members having connector terminals projecting from said housing and aligned along a common axis extending substantially perpendicular to said longitudinal axis, a pair of switches each having a pair of contacts, one of said pair of contacts being connected with one pair of said terminal members, and the other of said pair of contacts being connected with another pair of said terminal members.

2. The device of claim 1 wherein each said switch includes a movable contact, each said movable contact being attached to an elongated movable arm, said arms being connected with different ones of said terminal members and being spaced-apart from one another in a direction parallel to said longitudinal axis, and said arms being in parallel aligned relationship to one another.

3. The device of claim 2 wherein said arms have longitudinal arm axes extending substantially perpendicular to said common axis.

4. The device of claim 2 wherein said switches have fixed contacts and both said movable and fixed contacts of both said switches are aligned along a common axis.

5. The device of claim 2 wherein each said switch includes a fixed contact and said connector terminals include a pair of outside terminals and a pair of inside terminals, said outside terminals being connected with said fixed contacts and said inside terminals being connected with said movable contacts.

6. In a thermostat having a generally hollow cylindrical housing containing a pair of switches each having a pair of contacts and a terminal member connected with each contact, each said terminal member having a connector terminal projecting externally of said housing, said connector terminals being aligned along a common axis, each said terminal member being directly connected with its respective switch contacts, each said pair of contacts in each of said switches having open and closed positions, and thermal responsive means for moving said contacts between said positions.

7. The thermostat of claim 6 wherein all of said switch contacts are aligned along a common axis.

8. The thermostat of claim 6 wherein said terminal members are attached to said housing at locations spaced both axially and circumferentially from one another.

9. The thermostat of claim 6 wherein each said switch includes a movable arm, for moving said contacts between said open and closed positions, said arms being spaced-apart one above the other in aligned relationship.

10. The thermostat of claim 9 wherein said arms have longitudinal axes lying in a common plane extending substantially perpendicular to said common axis along which said connector terminals extend.

11. The thermostat of claim 6 wherein all of said terminal members have a different shape.

12. The thermostat of claim 6 wherein said switch contacts include fixed contacts and movable contacts, two of said terminal members having said fixed contacts mounted thereon, a pair of movable arms having first and second opposite end portions, said movable contacts being mounted at said first end portions of said movable arms, and two of said terminal members being attached to said second end portions of said movable arms.

13. A thermostat including a pair of switches, each switch having a pair of contacts, a terminal member attached to each said contact, each said terminal member having a connector terminal, all of said connector terminals being aligned along a common axis, said switches being spaced-apart in aligned relationship in a direction substantially perpendicular to said common axis, each said pair of contacts in each of said switches having open and closed positions, and thermal responsive means for moving said contacts between said positions.

14. The thermostat of claim 13 wherein each said terminal member includes a substantially flat base having a said connector terminal extending substantially perpendicular therefrom.

15. The thermostat of claim 14 wherein each said connector terminal on each said terminal member has a different length from its base to its free end.

16. The thermostat of claim 13 including a substantially cylindrical housing in which said switches and terminal members are mounted.

17. The thermostat of claim 16 wherein said housing has a plurality of internal steps at different circumferential and axial positions therein, one of said terminal members being attached to each of said steps.

18. The thermostat of claim 13 wherein one said contact in each said switch is connected to a common one of said terminal members.

* * * * *